US008104273B2

(12) United States Patent
Barrieu et al.

(10) Patent No.: US 8,104,273 B2
(45) Date of Patent: Jan. 31, 2012

(54) DOUBLE-SHELL MANIFOLD

(75) Inventors: Edouard Barrieu, Belfort (FR); Vincent Leroy, Montbeliard (FR)

(73) Assignee: Faurecia Systemes d'Echappement, Nanterre (FR)

( * ) Notice: Subject to any disclaimer, the term of this patent is extended or adjusted under 35 U.S.C. 154(b) by 181 days.

(21) Appl. No.: 11/913,586

(22) PCT Filed: Apr. 28, 2006

(86) PCT No.: PCT/FR2006/000970

§ 371 (c)(1),
(2), (4) Date: Nov. 5, 2007

(87) PCT Pub. No.: WO2006/117468

PCT Pub. Date: Nov. 9, 2006

(65) Prior Publication Data

US 2009/0266065 A1 Oct. 29, 2009

(30) Foreign Application Priority Data

May 4, 2005 (FR) ..... 05 04585

(51) Int. Cl.
*F01N 1/00* (2006.01)
*B21D 51/16* (2006.01)
*B23P 17/00* (2006.01)

(52) U.S. Cl. ..... 60/323; 29/890.08

(58) Field of Classification Search ..... 60/313, 60/323, 321; 29/890.08, 890.052
See application file for complete search history.

(56) References Cited

U.S. PATENT DOCUMENTS

| | | | | |
|---|---|---|---|---|
| 4,197,704 | A | 4/1980 | Date et al. | |
| 5,013,501 | A * | 5/1991 | Fukao et al. | 264/636 |
| 5,392,601 | A * | 2/1995 | LeVine | 60/293 |
| 5,419,127 | A | 5/1995 | Moore et al. | |
| 5,937,643 | A * | 8/1999 | Wang | 60/323 |
| 5,961,154 | A * | 10/1999 | Williams et al. | 285/22 |
| 6,523,343 | B2 * | 2/2003 | Durr et al. | 60/323 |

FOREIGN PATENT DOCUMENTS

| | | |
|---|---|---|
| EP | 0 340 946 | 11/1989 |
| EP | 0 696 677 | 2/1996 |
| FR | 2 272 966 | 12/1975 |

* cited by examiner

*Primary Examiner* — Thomas Denion
*Assistant Examiner* — Audrey K Bradley
(74) *Attorney, Agent, or Firm* — Young & Thompson

(57) ABSTRACT

This exhaust manifold (12) includes:
an outer casing (18) includes:
an outer shell (22);
a flange (24) which is welded to the outer shell (22) and which has a surface (24B) for abutment against an engine cylinder head and at least one aperture (28) which opens at the abutment surface (24A),
at least one inner channel (20) which is arranged in the outer casing (18) and which opens via an aperture (28). The or each inner channel (20) is formed from a ceramic material; and extends from one side to the other of the flange (24) through the or each aperture (28) and comprises a continuation (32) outside the outer casing (18) which extends outwards beyond the abutment surface (24A).

18 Claims, 4 Drawing Sheets

DOUBLE-SHELL MANIFOLD

BACKGROUND OF THE INVENTION

1. Field of the Invention

The present invention relates to an exhaust manifold for an exhaust line of an internal combustion engine, of the type comprising:

an outer casing comprising:

an outer shell;

a flange which is welded to the outer shell and which has a surface for abutment against an engine cylinder head and at least one aperture which opens at the abutment surface, at least one inner channel which is arranged in the outer casing and which opens via an aperture.

2. Description of the Related Art

Currently, vehicles having heat engines are provided with exhaust lines which include depollution elements such as catalytic purification elements and/or particulate filters. In order to allow these depollution elements to operate in a satisfactory manner, the exhaust gases must reach them at a high temperature. It is therefore advantageous to prevent an excessive loss of heat in the exhaust line and in particular in the manifold which separates the outlet of the heat engine from the first depollution element.

Various solutions have been envisaged for this purpose. In particular, manifolds which comprise inner channels which are retained in an external shell which is separated from the inner channels by an air space or an insulating material are found to be effective in preventing an excessive loss of heat.

These manifolds comprise a flange for fixing to the engine cylinder head on which the inner channels, on the one hand, and the outer shell, on the other hand are supported.

It has been found that the metal flange dissipates a large amount of thermal energy from the exhaust gases as they pass through the flange.

BRIEF SUMMARY OF THE INVENTION

The object of the invention is to provide an exhaust manifold which reduces heat losses and which allows very hot exhaust gases to be conveyed to the downstream portion of the exhaust line.

To this end, the invention relates to a manifold of the above-mentioned type, characterised in that:

at least one inner channel is formed from a ceramic material; and the at least one inner channel extends from one side to the other of the flange through the or each aperture and comprises a continuation outside the outer casing which extends outwards beyond the abutment surface.

According to specific embodiments, the manifold comprises one or more of the following features:

the length of the continuation is between 10 mm and 20 mm;

the clearance defined between the flange and the or each inner channel through the or each aperture is less than 0.5 mm;

at least one channel has the same thickness along The continuation beyond the aperture and through the aperture;

the continuation comprises a portion of excessive external thickness along the length of the or each inner channel which protrudes relative to the abutment surface and the cross-section of the or each aperture of the flange is greater than the outer cross-section of the continuation which has the portion of excessive thickness;

the portion of excessive thickness extends only beyond the abutment surface;

the manifold comprises an outer collar which surrounds the continuation of the or each inner channel which protrudes beyond the abutment surface and the outer cross-section of the collar is greater than the cross-section of the aperture;

the collar comprises a ring of intumescent material; and the manifold comprises a sealing joint between the outer shell and the or each channel, which joint is in abutment against the flange.

The invention also relates to an engine which comprises a cylinder head which delimits exhaust outlets and a manifold as defined above which is fitted to the cylinder head with the abutment surface against the cylinder head and the apertures facing the exhaust outlets, characterised in that the exhaust outlets have an overbore which is open facing the manifold and the continuation of the at least one inner channel of the manifold is received in the or each space delimited by the overbore.

BRIEF DESCRIPTION OF THE DRAWING FIGURES

The invention will be better understood from a reading of the following description, given purely by way of example and with reference to the drawings, in which.

DETAILED DESCRIPTION OF THE INVENTION

Figure 1:
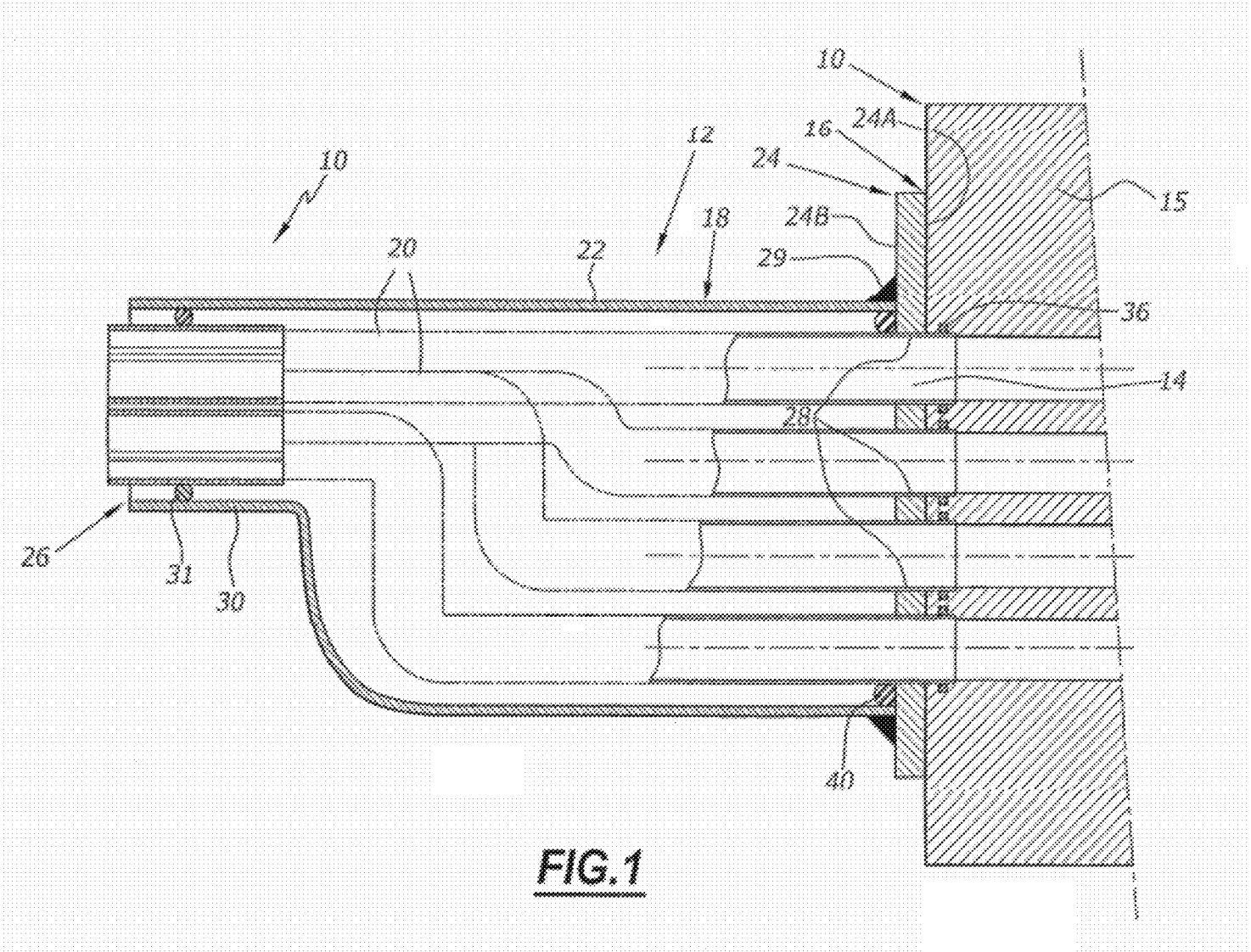
FIG. 1 is a partially cut-away front view of an exhaust manifold according to the invention which is associated with the cylinder head of an engine.

FIG. 1 illustrates a heat engine 10 which is coupled to an exhaust manifold 12. The heat engine comprises, for example, four cylinders, to each of which a valve channel 14 is connected and forms an exhaust outlet which is provided through a cylinder head 15 of the engine.

The four outlets 14 open in the same plane 16 of the cylinder head to which the inlet of the exhaust manifold 12 is fixed.

The manifold 12 substantially comprises a sealed outer casing 18 in which four tubes 20 are received which form discharge channels for the exhaust gases. Each tube is associated with an exhaust outlet of a cylinder of the heat engine 10.

The casing 18 comprises an outer shell 22 which surrounds all the tubes 20 and a flange 24 for connecting the manifold to the cylinder head 15 of the engine.

The outer shell 22 is formed, for example, by two metal half-shells which are assembled with each other by means of a central peripheral weld seam. This shell defines a profile which converges from the flange 24 towards an outlet end 26.

The flange 24 is formed by a solid plate which has four inlet apertures 28 which are located opposite the discharge apertures 14 of the engine. It further comprises apertures for the passage of screws for fixing the manifold to the cylinder head.

The flange has a main outer face which forms an abutment surface 24A in the plane 16 of the cylinder head and an opposing inner face 24B to which the outer shell 22 is fixed by means of an external weld seam 29.

The inner tubes 20 are formed from a ceramic material such as those described in the patent applications U.S. Pat. Nos. 6,134,881, 6,161,379, 6,725,656 and WO-2004/106705. These materials comprise a composite matrix based on inorganic polymer reinforced with fibres, preferably ceramic fibres. These materials are particularly advantageous owing to their high level of thermal inertia, their mechanical properties which allow them to withstand the flow of hot gases present in the exhaust and the vibration forces which are specific to motor vehicles, and finally owing to their temperature resistance with respect to the hot gases which are discharged from an internal combustion engine.

The thickness of the tubes in their standard portion is between 0.4 and 0.8 mm. They converge towards each other from the inlet apertures 28 of the manifold which each correspond to a cylinder in order to form a bundle of tubes which open at the outlet 26 of the manifold through a substantially tubular portion 30 which forms the outlet 26 of the casing.

The tubes 20 are preferably independent from each other along the entire length thereof. In this manner, they are arranged in a contiguous manner in the outlet portion 30. They all open in the same plane which is transverse relative to the portion 30 in the region of their downstream end. At this end, each tube has a cross-section in the form of a quarter-disc.

The four tubes are retained in a radial position in the channel 30 by means of a joint 31 which is formed by a ring in the form of a metal lattice.

Figure 2:
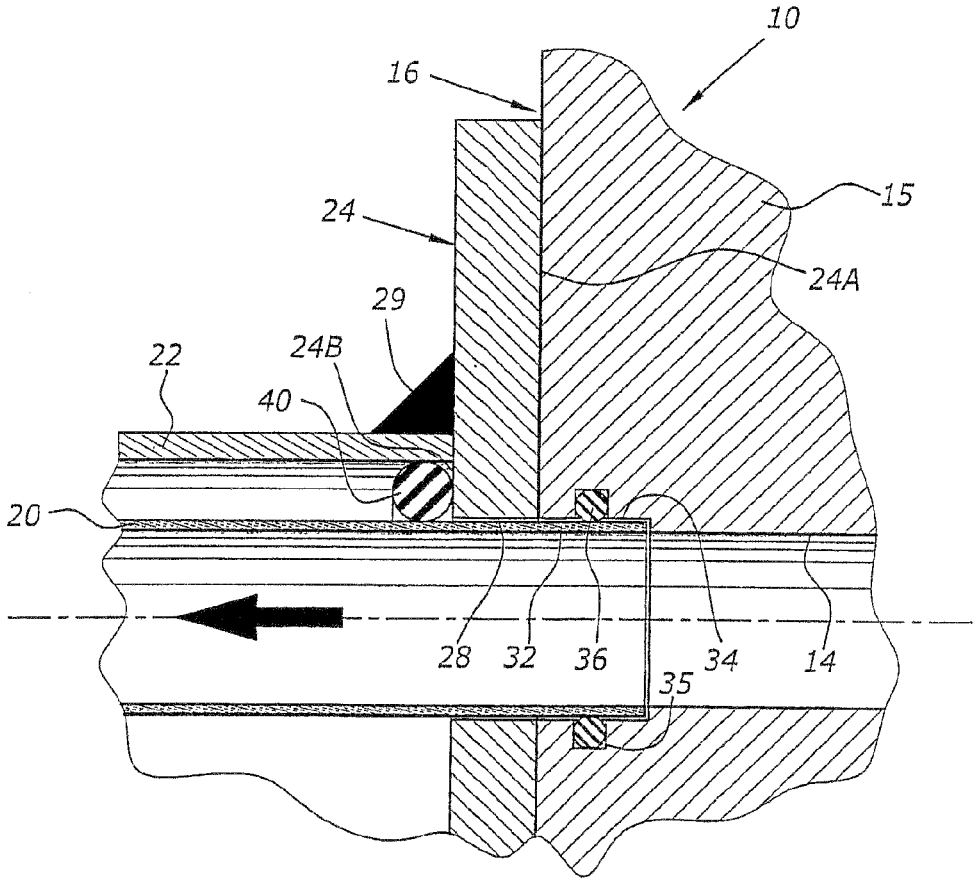
FIG. 2 is a detailed section of the connection of the exhaust manifold and the cylinder head of an engine.

At the other end thereof, the tubes 20 each extend through an orifice 28. Each tube extends from one side to the other of the flange 24 through an orifice 28 as illustrated in FIG. 2 and has a continuation 32 outside the outer casing 18 beyond the abutment surface 24A of the flange. The continuation 32 protrudes axially relative to the abutment surface 24A by a length of between 1 cm and 2 cm.

The continuation 32 is received in an overbore 34 which is provided at the open end of the associated discharge outlet 14. The additional cross-section provided by the overbore 34 is very slightly greater than the thickness of the tube 20. In the same manner, each aperture 28 has a cross-section which corresponds to the cross-section of the overbore and which is strictly aligned therewith. The length of the overbore is very slightly greater than that of the continuation 32. In this manner, the axial and/or radial clearance between the overbore 34 and the continuation 32 is very small and in particular less than 0.5 mm.

Advantageously, a peripheral recess 35 is provided in the peripheral wall of the overbore 34. A sealing joint 36 is received in this recess and is capable of pressing against the outer surface of the continuation 32 of the relevant tube.

In the same manner, a sealing joint 40 is arranged between the outer shell 22 and the bundle of tubes along the inner surface 24B of the flange.

These joints are formed, for example, from long ceramic fibres or a mixture of long ceramic fibres and a metal lattice.

Since ceramic is an insulating material, with an arrangement of this type, the flow of gases is isolated from the flange 24 by each of the tubes 20 which extend through the flange. Furthermore, the continuations 32, which separate the cylinder head from the gas flow in the region of the flange, also prevent a transfer of heat from the gases to the flange through the cylinder head.

The use of a ceramic material, owing to the very small expansion of the tubes, further allows very precise adjustment between the tubes, the flange and the cylinder head.

Figure 3:
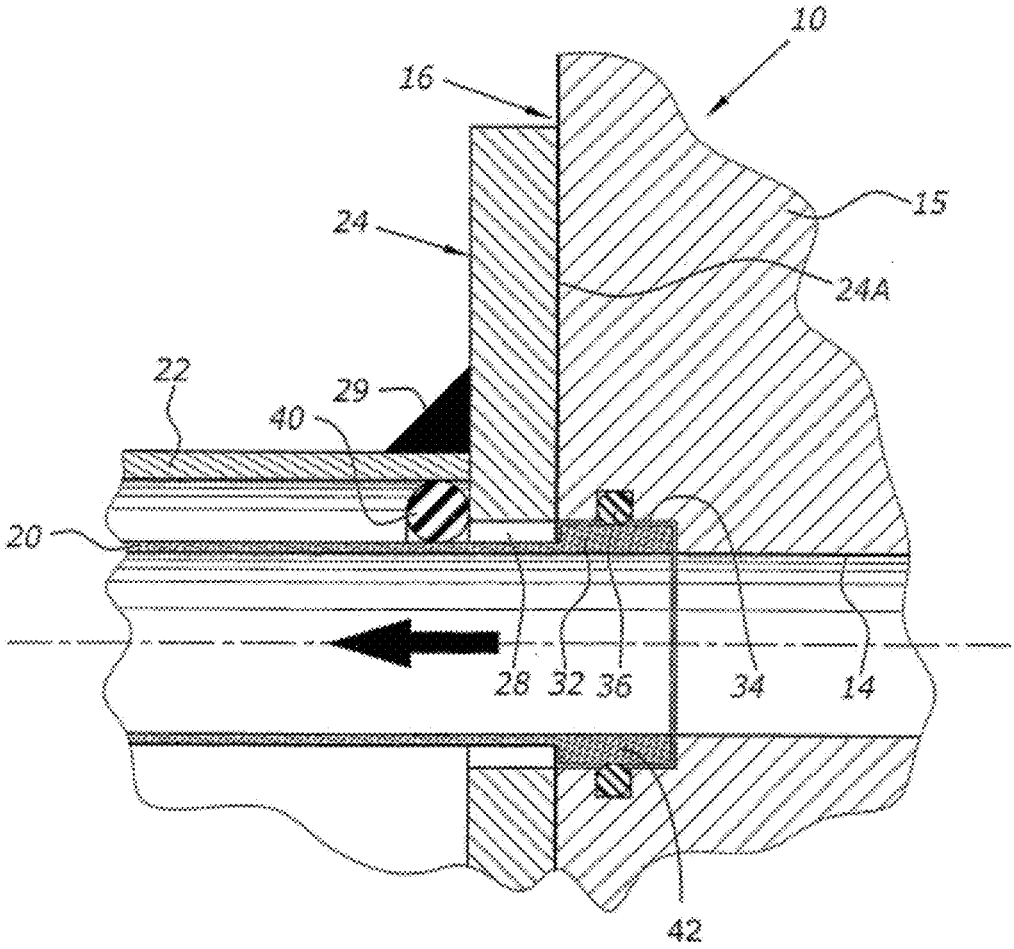
FIGS. 3 and 4 are views identical to that of FIG. 2 of construction variants of the manifold and the cylinder head.

In the embodiment illustrated in FIG. 3, each tube 20 has, at the end thereof received in the overbore 34 of each exhaust outlet 14, a portion of excessive external thickness 42 which extends only along the continuation 32 beyond the abutment face 24A of the flange. This portion of excessive thickness is, for example, between the thickness and three times the standard thickness of the tubes 20. In this arrangement, the cross-section of the apertures 28 of the flange is very slightly greater than the outer cross-section of the continuation 32 of the tubes 20 which have the portion of excessive thickness 42.

In this embodiment, the thermal insulation is further increased between the exhaust gases and the region of the cylinder head in contact with the flange owing to the portion of excessive thickness of the continuation.

Figure 4:
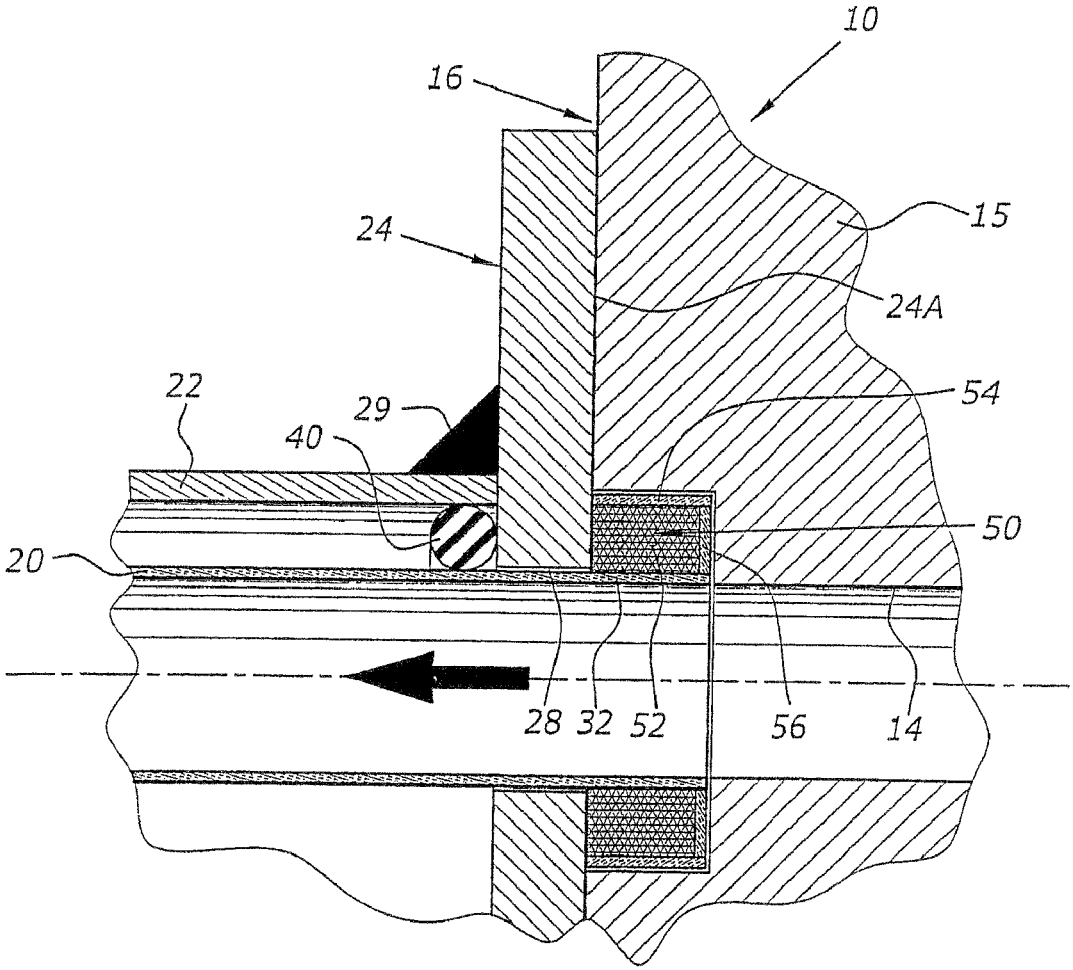

In the embodiment of FIG. 4, the apertures 28 have a cross-section which substantially corresponds to the outer cross-section of the tubes 20. The continuation 32 of each tube comprises an outer collar 50 which surrounds the end of the tube which protrudes beyond the abutment surface 24A.

This collar 50 comprises a ring 52 which is formed from an intumescent material and which is itself surrounded by a peripheral hoop 54 which is formed, for example, from ceramic material. At the end thereof, the collar 50 comprises a crown 56, for example, of ceramic material interposed between the end of the continuation 32 and that of the hoop 54.

The total thickness of the collar is, for example, between 3 mm and 7 mm.

In this embodiment also, an increased level of thermal insulation is obtained between the exhaust gases and the portion of the cylinder head in contact with the flange 24.

The invention claimed is:

1. An exhaust manifold (12) comprising:

an outer casing (18) comprising:

an outer shell (22);

a flange (24) which is welded to the outer shell (22) and which has a surface (24B) for abutment against an engine cylinder head and at least one aperture (28) which opens at the abutment surface (24A);

at least one inner channel (20) which is arranged in the outer casing (18) and which opens via the at least one aperture (28); and a sealing joint (40) between the outer shell (22) and the at least one inner channel (20), the sealing joint (40) being in abutment against the flange (24), wherein the at least one inner channel (20) is formed only from a ceramic material, and the at least one inner channel (20) extends from one side to the other of the flange (24) through the at least one aperture (28) and comprises a continuation (32) formed only from ceramic material outside the outer casing (18) which extends outwards beyond the abutment surface (24A), and a length of the continuation (32) is between 10 mm and 20 mm, the at least one inner channel having an outer surface facing directly an inner surface of the at least one aperture.

2. The exhaust manifold according to claim 1, wherein the inner channel has an inner surface which is free.

3. The exhaust manifold according to claim 1, wherein the exhaust manifold further comprises an outer collar (50) which surrounds the continuation (32) of the at least one inner channel (20) which protrudes beyond the abutment surface (24A) and in that an outer cross-section of the collar (50) is greater than a cross-section of the aperture (28).

4. The exhaust manifold according to claim 3, wherein the collar (50) comprises a ring (52) of intumescent material.

5. An engine, comprising:

a cylinder head (15) which delimits exhaust outlets (14); and an exhaust manifold (12) according to claim 1 which is fitted to the cylinder head (15) with the abutment surface (24A) against the cylinder head and the apertures (28) facing exhaust outlets (14), wherein the exhaust outlets (14) have an overbore (34) which is open facing the manifold (12) and the continuation (32) of the at least one inner channel (20) of the manifold is received in a space delimited by each overbore (34).

6. The engine according to claim 5, wherein a radial clearance between the overbore and the continuation is less than 0.5 mm.

7. The exhaust manifold according to claim 1, wherein a clearance defined between the flange (24) and the at least one inner channel (20) through the at least one aperture (28) is less than 0.5 mm.

8. The exhaust manifold according to claim 7, wherein the at least one channel (20) has a same thickness along the continuation (32) beyond the aperture (28) and through the aperture (28).

9. The exhaust manifold according to claim 7, wherein the exhaust manifold further comprises an outer collar (50) which surrounds the continuation (32) of the at least one inner channel (20) which protrudes beyond the abutment surface (24A) and in that an outer cross-section of the collar (50) is greater than a cross-section of the aperture (28).

10. The exhaust manifold according to claim 1, wherein the at least one continuation (32) comprises a portion of excessive external thickness (42) along a length of the at least one inner channel (20) which protrudes relative to the abutment surface (24B) and a cross-section of the at least one aperture (28) of the flange (24) is greater than an outer cross-section of the continuation (32) which has the portion of excessive thickness (42).

11. The exhaust manifold according to claim 10, wherein the portion of excessive thickness (42) extends only beyond the abutment surface (24B).

12. The exhaust manifold according to claim 10, wherein the portion of excessive external thickness (42) is between a thickness and three times the thickness of the at least one inner channel (20).

13. An exhaust manifold comprising:

an outer casing comprising:

an outer shell;

a flange which is welded to the outer shell and which has a surface for abutment against an engine cylinder head and a plurality of apertures which open at the abutment surface;

a plurality of tubes formed only from a ceramic material arranged in the outer casing and which open via the plurality of apertures; and a sealing joint between the outer shell and the plurality of ceramic tubes, the sealing joint being in abutment against the flange, wherein the plurality of tubes extend from one side to an other side of the flange through the plurality of apertures and each tube has a continuation formed only from ceramic material outside the outer casing which extends outwards beyond the abutment surface, and a length of the continuation is between 10 mm and 20 mm.

14. The exhaust manifold according to claim 13, wherein a clearance defined between the flange and each tube through each aperture is less than 0.5 mm.

15. The exhaust manifold according to claim 14, wherein each tube has a same thickness along the continuation beyond the corresponding aperture and through the aperture.

16. The exhaust manifold according to claim 13, wherein each continuation comprises a portion of excessive thickness between a thickness and three times the thickness of the corresponding tube, along a length of the corresponding tube which protrudes relative to the abutment surface, and a cross-section of each aperture of the flange is greater than an outer cross-section of the continuation which has the portion of thickness between the thickness and three times the thickness of the corresponding tube.

17. The exhaust manifold according to claim 16, wherein the portion of thickness between the thickness and three times the thickness of the corresponding tube extends only beyond the abutment surface.

18. An exhaust manifold (12) comprising:

an outer casing (18) comprising:

an outer shell (22);

a flange (24) which is welded to the outer shell (22) and which has a surface (24B) for abutment against an engine cylinder head and at least one aperture (28) which opens at the abutment surface (24A);

at least one inner channel (20) which is arranged in the outer casing (18) and which opens via the at least one aperture (28) and a sealing joint (40) between the outer shell (22) and the at least one inner channel (20), the sealing joint (40) being in abutment against the flange (24), wherein the at least one inner channel (20) is formed only from a ceramic material, and the at least one inner channel (20) extends from one side to the other of the flange (24) through the at least one aperture (28) and comprises a continuation (32) formed only from ceramic material outside the outer casing (18) which extends outwards beyond the abutment surface (24A), the at least one inner channel having an outer surface facing directly an inner surface of the at least one aperture.

* * * * *